US011441318B2

(12) United States Patent
Spremulli et al.

(10) Patent No.: US 11,441,318 B2
(45) Date of Patent: Sep. 13, 2022

(54) MODULAR STAIRCASE AND METHOD OF CONSTRUCTING SAME

(71) Applicant: Peter Spremulli, Woodbridge (CA)

(72) Inventors: Peter Spremulli, Woodbridge (CA); Mario Berlingeri, Modena (IT)

(73) Assignee: Peter Spremulli, Woodbridge (CA)

( * ) Notice: Subject to any disclaimer, the term of this patent is extended or adjusted under 35 U.S.C. 154(b) by 15 days.

(21) Appl. No.: 16/881,036

(22) Filed: May 22, 2020

(65) Prior Publication Data

US 2020/0407980 A1 Dec. 31, 2020

(30) Foreign Application Priority Data

Jun. 27, 2019 (CA) ..... CA 3048291

(51) Int. Cl.
*E04F 11/035* (2006.01)

(52) U.S. Cl.
CPC ..... *E04F 11/035* (2013.01)

(58) Field of Classification Search
CPC ..... E04F 11/035; E04F 11/038; E04F 11/06; E04F 11/025; E04F 11/022; E04F 2011/0209
USPC ..... 52/182, 188, 191
See application file for complete search history.

(56) References Cited

U.S. PATENT DOCUMENTS 29,103 A * 7/1860 Roberts ..... B27C 5/08 142/43
67,328 A * 7/1867 McInroy ..... F26B 3/283 34/68
888,882 A * 5/1908 Grossman ..... E04F 11/025 52/188
947,743 A * 1/1910 Steiber ..... E04F 11/025 52/188
973,109 A * 10/1910 Griner ..... E04F 11/025 52/188

(Continued)

FOREIGN PATENT DOCUMENTS

AU 2015200568 A1 8/2015
DE 2753345 * 10/1977 ..... E04F 11/035
JP 06180050 * 12/1992 ..... E04F 11/02

OTHER PUBLICATIONS

IStair MPI Concepts, printed from https://www.i-stair.com/ on Sep. 25, 2020, 5 pp.

(Continued)

*Primary Examiner* — Kyle J. Walraed-Sullivan
(74) *Attorney, Agent, or Firm* — Nixon & Vanderhye P.C.

(57) ABSTRACT

A modular staircase frame is lightweight, adjustable, and may be brought to a worksite in pieces to be assembled. The modular staircase frame includes two opposing sets of laterally spaced blades, which may be adjustably connected to form laterally spaced ascending frame members. The opposing sets of blades may include a first pair of blades and a final pair of blades to anchor the frame to a first and second surface, respectively. The blades have openings for adjustable attachment of adjacent blades. The frame may also include stiffeners for added structural support. The opposing sets of laterally spaced blades may further include one or more corner blades for changing the direction of the staircase. Once the frame is installed, treads (temporary or final) can be removably installed on the frame to create a staircase.

10 Claims, 6 Drawing Sheets

(56) References Cited

U.S. PATENT DOCUMENTS 1,069,596 A * 8/1913 Baldry ..... E04F 11/025 52/188
1,256,905 A * 2/1918 Kass ..... E04C 2/427 52/180
1,257,221 A * 2/1918 Grossman ..... E04F 11/025 52/188
1,568,568 A * 1/1926 Nagin ..... E04F 11/025 52/191
2,724,466 A * 11/1955 Phillips ..... E04F 11/022 52/191
3,039,829 A * 6/1962 Onulak ..... B21D 37/10 384/30
3,196,997 A * 7/1965 Hager ..... E04F 11/035 52/182
3,962,838 A * 6/1976 Cox ..... E04F 11/0255 52/183
4,143,740 A * 3/1979 Matthews ..... E04F 11/025 182/93
4,355,700 A * 10/1982 Matthews ..... E06C 9/02 182/106
4,422,270 A * 12/1983 Lapointe ..... E04F 11/035 52/182
4,527,366 A * 7/1985 Greene ..... E04F 11/025 182/83
4,583,334 A * 4/1986 Hubbard ..... E04F 11/1041 52/105
4,586,585 A * 5/1986 Zaner ..... E04F 11/0255 182/206
4,709,520 A * 12/1987 Vochatzer ..... E04F 11/025 182/220
4,819,391 A * 4/1989 Tassin ..... E04F 11/025 52/182
4,875,315 A * 10/1989 Champagne ..... E04F 11/025 52/189
5,369,921 A * 12/1994 Glenn ..... B60P 3/36 182/113
5,388,340 A * 2/1995 Marty ..... E04F 21/26 33/421
5,531,048 A * 7/1996 Darling ..... B27D 1/00 52/182
5,636,483 A * 6/1997 Wille ..... E04F 11/0255 182/228.1
5,778,610 A * 7/1998 Berg ..... E04F 11/1041 52/105
5,806,254 A * 9/1998 Bennett ..... E04F 11/035 248/300
5,899,032 A * 5/1999 Buzby ..... E04F 11/0255 52/182
5,983,580 A * 11/1999 Carr ..... E04F 11/032 52/182
6,088,977 A * 7/2000 Lawrence ..... E04F 11/1041 52/105
6,125,598 A * 10/2000 Lanphier ..... E04F 11/00 256/65.14
6,230,454 B1 * 5/2001 Meagher ..... E04F 11/108 52/182
6,354,403 B1 * 3/2002 Truckner ..... E04F 11/0255 182/1
6,758,016 B2 * 7/2004 Gobeil ..... E04F 11/00 182/228.3
7,946,085 B2 * 5/2011 Prins ..... E04F 11/025 52/191
8,091,294 B2 * 1/2012 Whalen ..... E06C 1/54 52/183
8,833,008 B2 * 9/2014 Truckner ..... E04F 11/181 52/191
8,887,456 B2 * 11/2014 Hyams ..... E04F 21/26 52/187
2003/0029103 A1 * 2/2003 Wack ..... E04F 11/035 52/189
2003/0093959 A1 * 5/2003 Couture ..... E04F 11/025 52/182
2004/0040229 A1 * 3/2004 Torch ..... E04F 11/116 52/189
2005/0236351 A1 * 10/2005 Curatolo ..... E04F 11/108 211/186
2006/0248817 A1 * 11/2006 Elwood ..... E04F 11/1043 52/182
2006/0272230 A1 * 12/2006 Elwood ..... A63B 71/02 52/182
2007/0144084 A1 * 6/2007 Barry ..... B27M 3/12 52/187
2009/0056268 A1 * 3/2009 Greenlee ..... E04F 11/025 52/702
2009/0151275 A1 * 6/2009 Naccarato ..... E04F 11/00 52/182
2009/0293385 A1 * 12/2009 Vargas ..... E04F 11/025 52/191
2010/0287854 A1 * 11/2010 Couture ..... E04F 11/02 52/184
2011/0067328 A1 * 3/2011 Naccarato ..... E04F 11/112 52/182
2011/0146169 A1 * 6/2011 Ronsheim ..... E04F 11/035 52/188
2012/0167494 A1 * 7/2012 Brooks ..... E04F 11/035 52/182
2016/0002931 A1 * 1/2016 Preston ..... E04F 11/038 52/182
2017/0356196 A1 * 12/2017 Jean ..... E04F 11/025

OTHER PUBLICATIONS

IStair Demonstration Video on Vimeo, located at https://vimeo.com/57028570, accessed Sep. 25, 2020, 2pp.

* cited by examiner

MODULAR STAIRCASE AND METHOD OF CONSTRUCTING SAME

CROSS-REFERENCES TO RELATED APPLICATIONS

This application claims the benefit of Canadian Patent Application No. 3,048,291, filed Jun. 27, 2019, the entire content of which is herein incorporated by reference.

STATEMENT REGARDING FEDERALLY SPONSORED RESEARCH OR DEVELOPMENT

Not Applicable

TECHNICAL FIELD

The present application relates generally to staircases, and more particularly relates to modular staircases and methods of constructing same.

BACKGROUND

Previously, in order to install a staircase between floors in a home, the staircase was generally fabricated off-site and transported to the home to be installed. The staircase would be bulky and heavy, and would require two or more individuals to bring it to the home, often in a large truck or trailer. In some cases, the staircase would need to be lowered into the house by a crane before the roof is installed. These conventional staircases are particularly difficult to install when a house has three, four, or more floors.

Conventional staircases also require wooden stringers or other structural elements placed between the floors being connected by the staircase in order to anchor the stairs and set the slope of the staircase. The structural element could be the wooden frame behind the drywall of a wall. The requirement for these additional structural elements limits the ability to mass produce staircases for multiple homes, since each staircase needs to be specifically fitted to the home it is being installed into. Also, since the structural elements are wooden, the extended use of the staircase leads to unwanted squeaking and creaking from the structural elements.

The previously known staircases also led to significant expense. Installing a conventional staircase required the use of at least one or two labourers, if not skilled tradespeople such as carpenters. Conventional staircases are also expensive since the finished treads are installed from the outset, and are then exposed to heavy use by contractors and other individuals working on the upper floors of a home during the building process. As a result, these finished treads would often need to be repaired between installation and the house being occupied.

Therefore, there is a need for a lightweight staircase frame that can be easily transported to and assembled at a job site, including a house. There is also a need for a staircase frame that allows for less costly maintenance of the stairs between the construction and occupation of a house.

SUMMARY OF THE DISCLOSURE

The present disclosure provides a lightweight, adjustable modular staircase frame that can be carried in through most normal-sized doorways and easily installed in a home or building. Alternatively, the modular staircase frame may be brought to a worksite in pieces to be assembled. The modular staircase frame of the present disclosure is easier to install than a fully constructed wooden staircase, and can be done by one or two labourers, or even the homeowner alone.

The modular staircase frame is comprised of two opposing sets of laterally spaced blades, which may be adjustably connected to form laterally spaced ascending frame members. The opposing sets of blades may comprise a first pair of blades and a final pair of blades to anchor the frame to a first and second surface, respectively. The blades comprise openings for adjustable attachment of adjacent blades. The frame may also comprise stiffeners for added structural support. The opposing sets of laterally spaced blades may further comprise one or more corner blades for changing the direction of the staircase.

Once the frame is installed, wood (or other material) treads can be removably installed on the frame to create a staircase. Other cladding, such as risers and coverings for the bottom and sides of the frame, can be added for aesthetic purposes. In order to preserve the stairs that the homeowner will eventually use, a set of temporary treads can be installed during the homebuilding process, which can then be replaced by the final set of treads just prior to the homeowner moving in.

According to one aspect, there is provided a modular staircase frame for supporting removable treads in the construction of a staircase, the modular staircase frame comprising: two opposing sets of laterally spaced blades, each set comprising a plurality of adjacent blades being adjustably connected to define an ascending formation relative to an adjacent blade, said two opposing sets of laterally spaced blades defining two laterally spaced ascending frame members, each blade defining a plurality of spaced apart openings adapted to receive a fastener for adjustable attachment to an adjacent blade, said two opposing sets of laterally spaced blades including a first pair of opposing laterally spaced blades each defining a flange for anchoring said first pair of opposing laterally spaced blades to a first surface, and a final pair of opposing laterally spaced blades remote from the first pair of opposing laterally spaced blades, each of said final pair of opposing laterally spaced blades defining a flange for anchoring said final pair of opposing laterally spaced blades to a second surface; and fasteners to adjustably connect each of said adjacent blades together.

According to another aspect, there is provided a modular staircase frame comprising: a pair of laterally spaced first end blades, each first end blade having a plurality of openings for receiving a fastener, the pair of laterally spaced first end blades configured to anchor the frame to a first base surface at a first height and to support a removable first end step; a pair of laterally spaced second end blades that are longitudinally spaced from the pair of first end blades, each second end blade having a plurality of openings for receiving a fastener, the pair of laterally spaced second end blades configured to anchor the frame to a second base surface at a second height and to support a removable second end step; a plurality of pairs of laterally spaced intermediate blades disposed between the first end blades and the second end blades, each intermediate blade having a plurality of openings for receiving a fastener, and each pair of laterally spaced intermediate blades configured to support a removable intermediate step; and a plurality of connecting blades, each connecting blade having at least two spaced openings for receiving a fastener, wherein each first end blade is removably connected to an adjacent intermediate blade by aligning the openings of one of the connecting blades to at least one user-defined opening on the first end blade and at least one user-defined opening on the adjacent intermediate blade, and inserting a fastener through the openings, each second end blade is removably connected to an adjacent intermediate blade by aligning the openings of one of the connecting blades to at least one user-defined opening on the second end blade and at least one user-defined opening on the adjacent intermediate blade, and inserting a fastener through the openings, and each intermediate blade is removably connected to an adjacent intermediate blade by aligning the openings of one of the connecting blades to at least one user-defined opening on each of the adjacent intermediate blades, and inserting a fastener through the openings.

According to another aspect, there is provided a method of constructing a modular staircase frame for supporting removable treads in the construction of a staircase, the method comprising: arranging two opposing sets of laterally spaced blades, each set comprising a plurality of adjacent blades, the two opposing sets of laterally spaced blades further including a first pair of opposing laterally spaced blades and a final pair of opposing laterally spaced blades remote from the first pair of opposing laterally spaced blades, to define two laterally spaced ascending frame members; anchoring the first pair of opposing laterally spaced blades to a first surface; anchoring the final pair of opposing laterally spaced blades to a second surface; and adjustably connecting each of said adjacent blades together to define an ascending formation relative to an adjacent blade.

DETAILED DESCRIPTION

The present disclosure relates to a modular staircase frame and method of constructing same. The modular staircase frame is lightweight, adjustable, and may be brought to a worksite in pieces to be assembled. The modular staircase frame is comprised of two opposing sets of laterally spaced blades, which may be adjustably connected to form laterally spaced ascending frame members. The opposing sets of blades may comprise a first pair of blades and a final pair of blades to anchor the frame to a first and second surface, respectively. The blades comprise openings for adjustable attachment of adjacent blades. The frame may also comprise stiffeners for added structural support. The opposing sets of laterally spaced blades may further comprise one or more corner blades for changing the direction of the staircase. Once the frame is installed, treads (temporary or final) can be removably installed on the frame to create a staircase.

Figure 1:
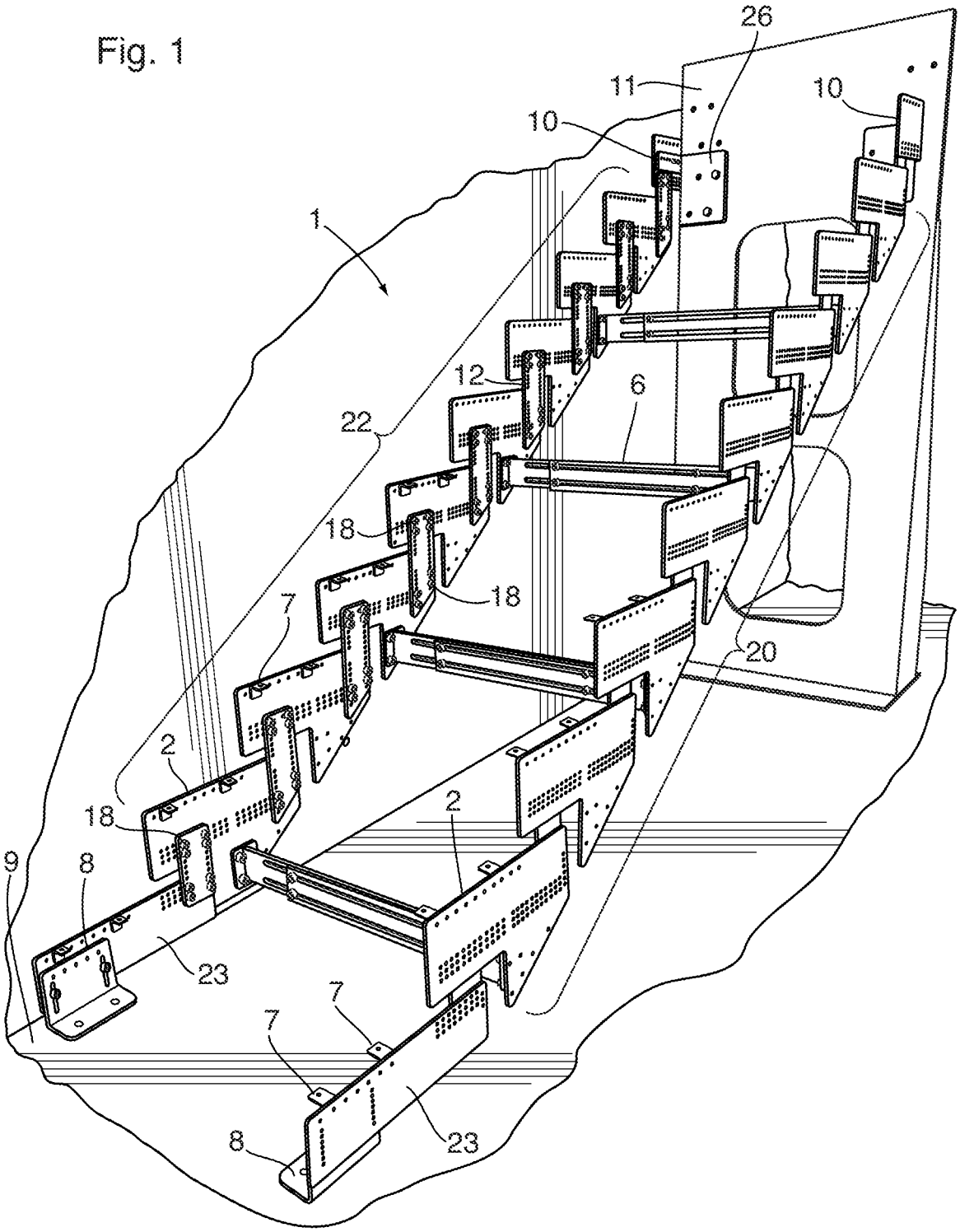
FIG. 1 is a perspective view of the modular staircase frame assembled in accordance with an embodiment of the disclosure.

Referring to FIG. 1, a modular staircase frame 1 is provided in assembled form. Although the frame 1 is shown in assembled form, individual components of the frame 1 may be packaged together or separately for assembly at a worksite, which may include a building site, a house either during construction or after construction has been completed, or any other site where a staircase may be installed. Due to the modular and adjustable nature of the frame 1, as described herein, the same components may be used regardless of the distance between floors being connected by the staircase, and regardless of the desired step height, length, and width.

The frame 1 comprises two opposing sets of laterally spaced blades 20, 22. Each set of laterally spaced blades comprises a plurality of adjacent blades 2 adjustably connected together in an ascending formation. The two opposing sets of laterally spaced blades 20, 22 form the laterally spaced ascending frame members of the modular staircase frame 1. At one end of the two opposing sets of laterally spaced blades 20, 22, there is a first pair of opposing laterally spaced blades 23. Remote from the first pair of opposing laterally spaced blades 23, there is a final pair of opposing laterally spaced blades 10.

As may be seen in FIG. 1, each of the first pair of opposing laterally spaced blades 23 defines a flange 8 for anchoring the first pair of opposing laterally spaced blades 23 to a first surface 9. The flange 8 may be integrally formed with each of the first pair of opposing laterally spaced blades 23, or it may be separately joined. In a preferred embodiment, the first surface 9 may be a horizontal floor, but the skilled person will appreciate that the first surface 9 may be any surface to which a staircase frame could be anchored.

Likewise, each of the final pair of opposing laterally spaced blades 10 defines a flange 26 for anchoring the final pair of opposing laterally spaced blades 10 to a second surface 11. The flange 26 may be integrally formed with each of the final pair of opposing laterally spaced blades 10, or it may be separately joined. In a preferred embodiment, the second surface 11 may be a vertical wall, but the skilled person will appreciate that the second surface 11 may be any surface to which a staircase frame could be anchored.

In a preferred embodiment, the blades 2, 10, and 23 may be made of aluminum, PVC, fiberglass, carbon fiber, plexiglass, polycarbonate, aluminum alloys, or titanium. In a less preferred embodiment, the blades 2, 10, and 23 may be made of steel. In a preferred embodiment, the blades, 2, 10, and 23 are at least ⅜" thick. The blades 2, 10, and 23 may also be symmetrical, so that the same blade could be used for either side of the pair of blades.

Since the two opposing sets of laterally spaced blades 20, 22 form the laterally spaced ascending frame members of the modular staircase frame 1, there is no need to use additional external structural elements, such as stringers or a wall, to support the staircase beyond the frame 1. Accordingly, the modular staircase frame 1 may be used to support a freestanding staircase.

In one embodiment, the two opposing sets of laterally spaced blades 20, 22 may also comprise a plurality of connecting blades 12. These may be interposed between the blades 2 to provide greater adjustability when connecting adjacent blades 2 together, as described below.

Figure 3:
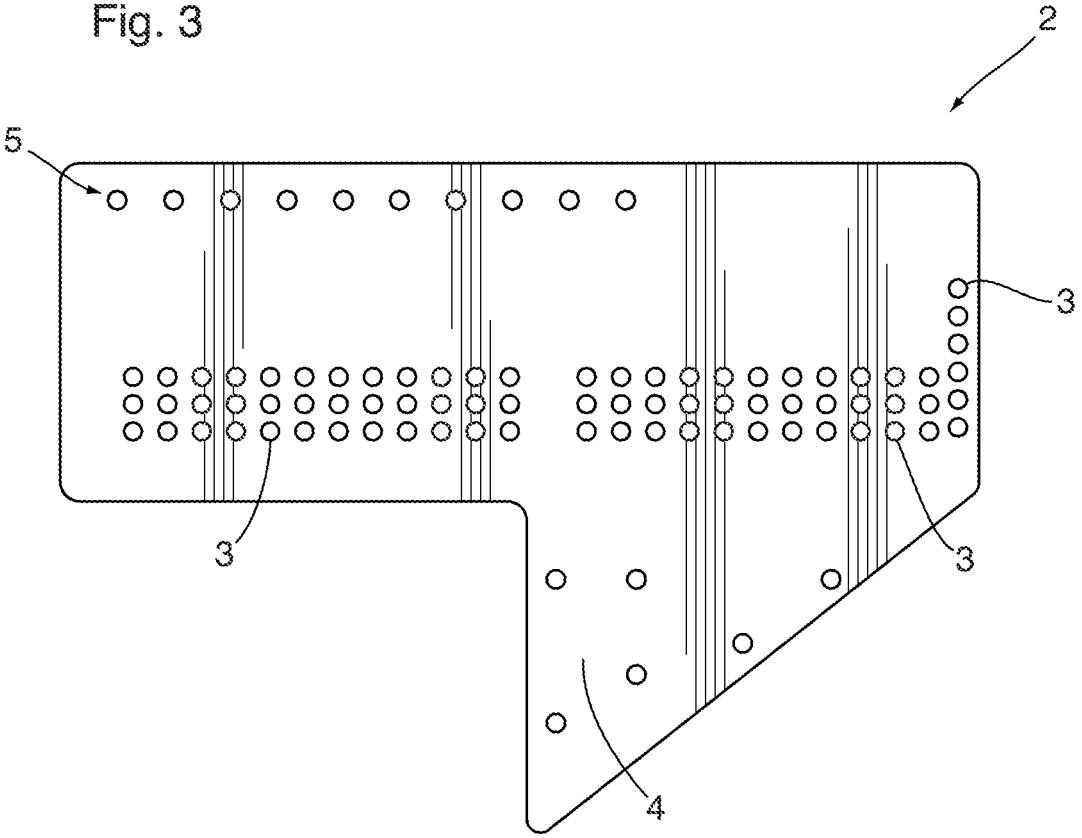
FIG. 3 is a side elevational view of a blade in accordance with an embodiment of the disclosure.
Figure 4:
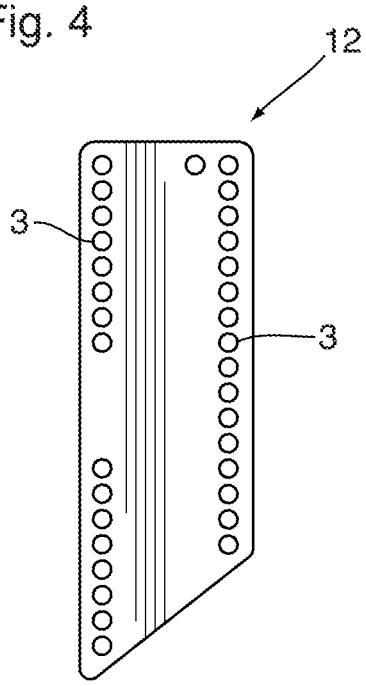
FIG. 4 is a side elevational view of a connecting blade in accordance with an embodiment of the disclosure.
Figure 5:
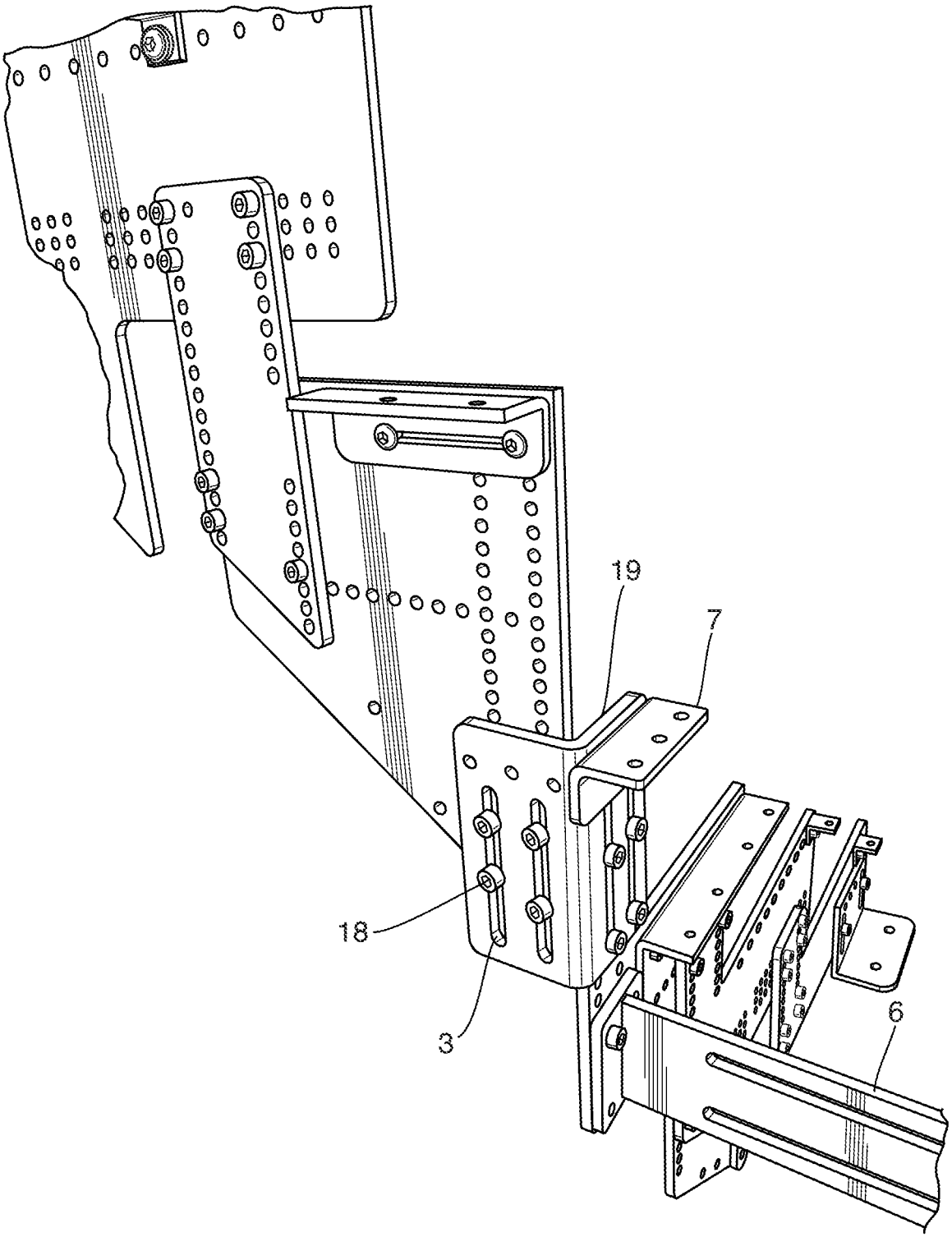
FIG. 5 is a perspective view of a portion of the modular staircase frame assembled in accordance with an alternative embodiment of the disclosure.

As shown in FIGS. 3 and 4, each of the blades 2 and connecting blades 12 have a plurality of spaced apart openings 3 that are adapted to receive a fastener 18. Each of the first pair of opposing laterally spaced blades 23 and the final pair of opposing laterally spaced blades 10 also have a plurality of spaced apart openings 3 that are adapted to receive a fastener 18. The openings 3 may be in the form of holes or channels, as shown in FIG. 5 with reference to corner blade 19.

Due to the number and spacing of the openings 3, adjacent blades 2 may be adjustably attached to each other by selecting the desired opening 3 on each adjacent blade 2 through which the fastener 18 may be inserted, in order to vary the height and distance between adjacent blades 2. Once the appropriate opening 3 is selected on adjacent blades, the openings 3 are aligned and a fastener 18 is removably inserted through the aligned openings 3 to fix the adjacent blades in place in an ascending formation at a desired height and distance. Multiple fasteners 18 may be used to provide added stability to the frame 1.

The modular staircase frame 1 may also comprise stiffeners 6 for added structural support. The blades 2 may have a stiffener fastening portion 4, and the stiffeners 6 may be removably fastened to the blades 2 at the stiffener fastening portion 4. The stiffeners 6 may be fastened to a single pair of blades 2, or to each pair of blades 2, but are preferably fastened to at least every other pair of blades 2, as shown in FIG. 1.

The stiffeners 6 may be of fixed length, but are preferably of adjustable length to vary the spacing between the two opposing sets of laterally spaced blades 20, 22. The stiffeners 6 may comprise a pin-in-slot system to vary the length of the stiffeners 6 and fix them at a preferred length.

As shown in FIG. 1, the blades 2, 10, and 23 may also define a flange 7 for supporting a removable tread, which may be a first end step 14, final end step (not shown), or intermediate step 16. The flange 7 may be integrally formed with the blade 2, 10, and 23, or it may be separately joined.

In the embodiment where the flange 7 is separately joined, it may be a bracket, which may be removably fastened to the bracket fastening portion 5 of the blades 2, 10, and 23. Preferably, at least one bracket is fastened to each blade 2, 10, and 23. More preferably, two brackets are fastened to each blade 2, 10, and 23 at a spaced apart distance to support and removably join the tread to the blade. The brackets may be made of any suitable material, and are preferably ⅛" to ¼" thick.

Since the treads may be removably fastened to the flanges 7, or removably secured to the blades 2, 10, and 23 (including by cutting notches into the treads), a set of temporary treads may be installed while a house is still under construction, to avoid damage to the final set of treads.

Figure 2:
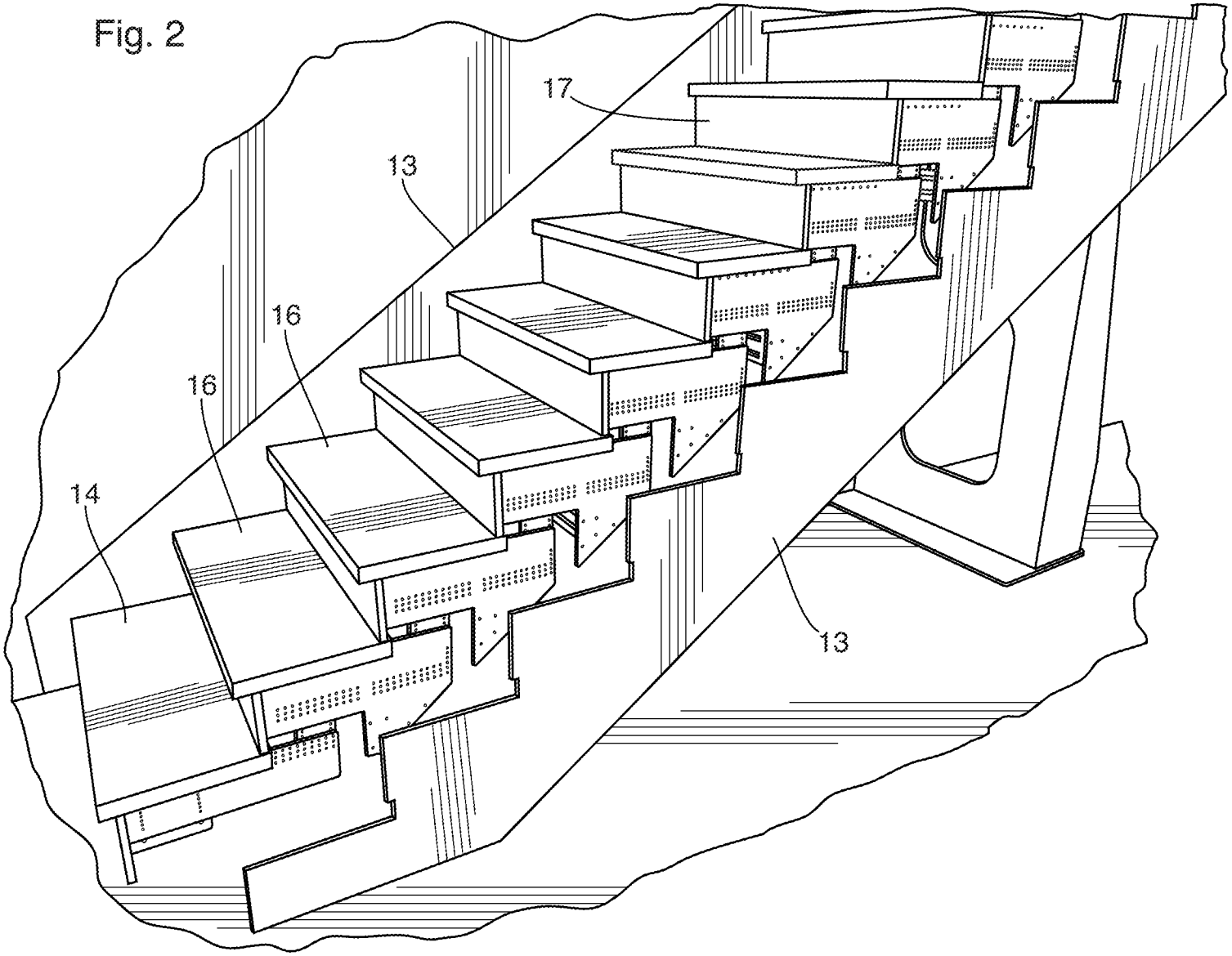
FIG. 2 is a perspective view of the modular staircase frame of FIG. 1 with removable treads and cladding.

The two opposing sets of laterally spaced blades 20, 22 are placed at a lateral distance from each other that may be selected by the user. In the embodiment shown in FIGS. 1 and 2, the lateral distance between the two opposing sets of laterally spaced blades 20, 22 is substantially equivalent to the width of the treads resting on the modular staircase frame 1.

In an alternative embodiment, the two opposing sets of laterally spaced blades 20, 22 may be placed close together, preferably at least 6" apart, in a "monolith" construction. In this alternative embodiment, the treads overhang the two opposing sets of laterally spaced blades 20, 22.

Depending on the aesthetic preference of the user, a staircase may also have risers 17 and additional cladding 13, which may cover the outside (shown in FIG. 2) and bottom (not shown) of the modular staircase frame 1.

Figure 6:
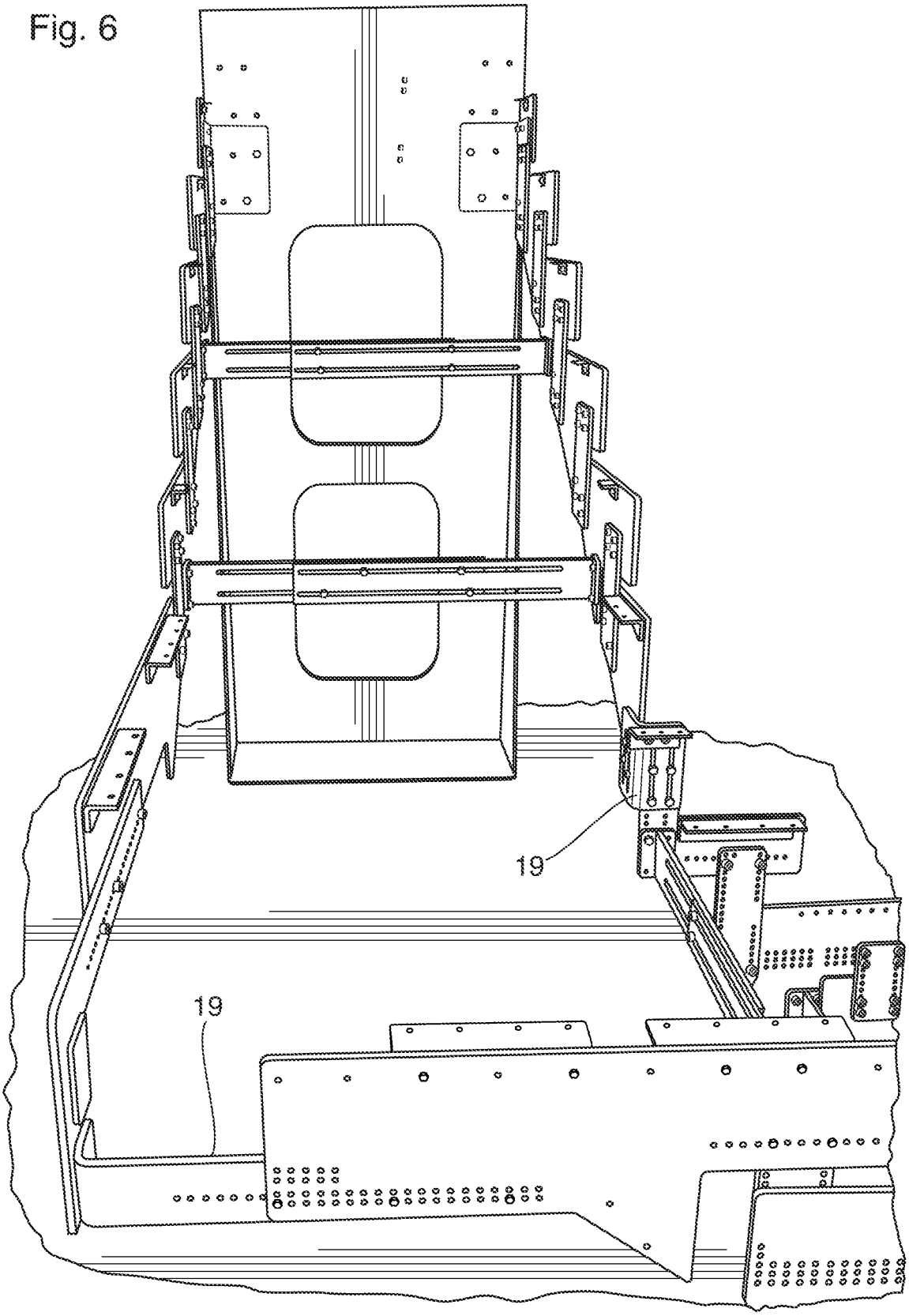
FIG. 6 is a front elevational view of the modular staircase frame shown in FIG. 5.
Figure 7:
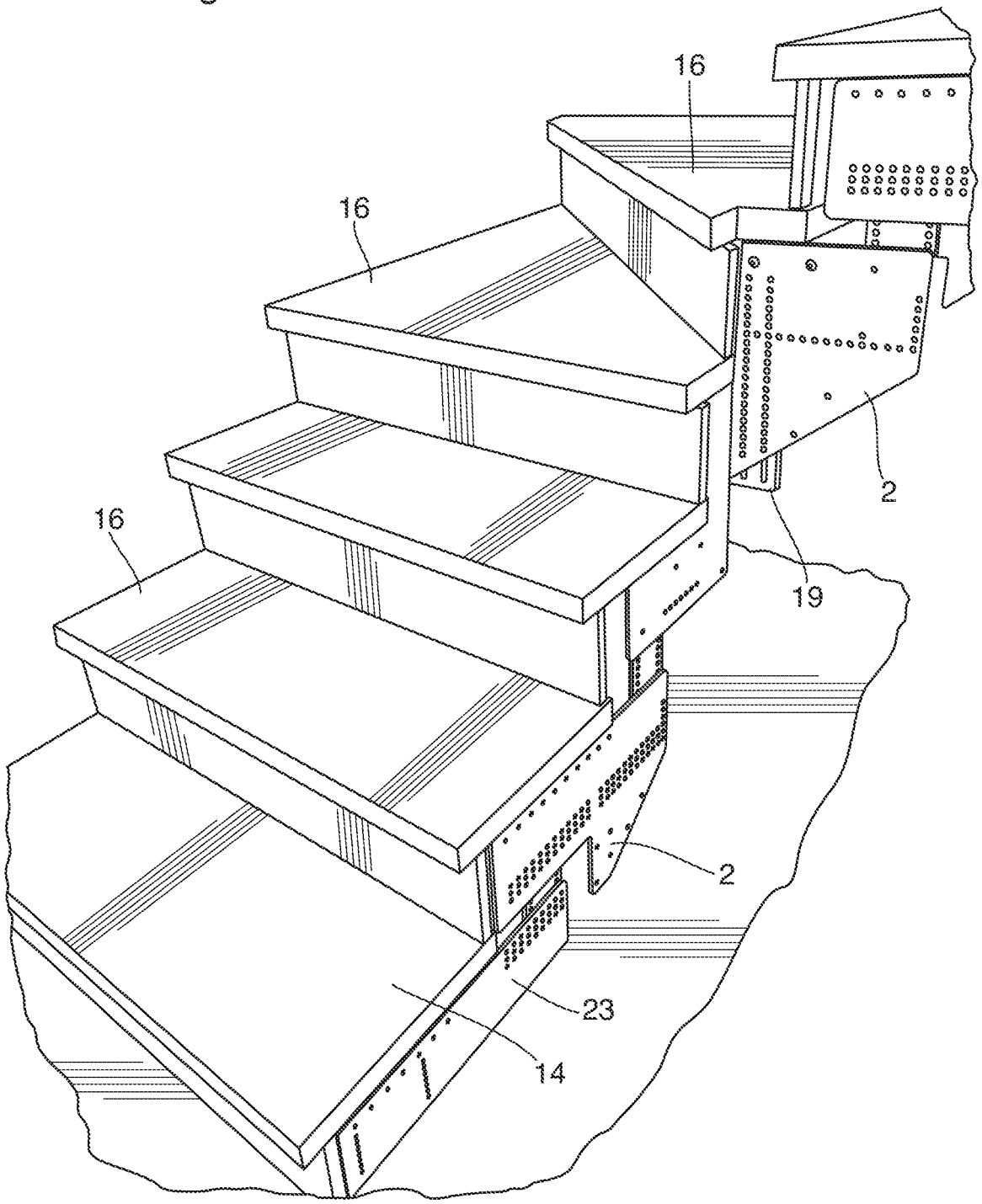
FIG. 7 is a perspective view of the modular staircase frame of FIGS. 5 and 6 with removable treads and risers attached.

The embodiment shown in FIG. 1 is a straight staircase between two floors. The present disclosure also contemplates a staircase that takes one or more turns. In the embodiment shown in FIGS. 5-7, each of the two opposing sets of laterally spaced blades 20, 22 further comprises at least one corner blade 19. The corner blade 19 connects two adjacent blades 2 around a turn that is preferably 90 degrees, but may be any suitable angle. The corner blades 19 and adjacent blades 2 may support two or more winder steps (as shown in FIG. 7), or a single landing.

The present disclosure also contemplates a method of construction of a modular staircase frame 1. As set out above, the modular staircase frame 1 comprises two opposing sets of laterally spaced blades 20, 22. In order to create the two opposing sets of laterally spaced blades 20, 22, a plurality of adjacent blades 2 are arranged in an ascending formation.

The first pair of opposing laterally spaced blades 23, each of which define a flange 8, are anchored to a first surface 9. Similarly, the final pair of opposing laterally spaced blades 10, each of which define a flange 26, are anchored to a second surface 11. The anchoring may be done using fasteners, or any other known method of anchoring a staircase frame to a surface.

Each adjacent blade 2, 10, and 23 is adjustably connected together in the manner described above to form the two laterally spaced ascending frame members of the modular staircase frame 1.

Although the invention has been described with reference to illustrative embodiments, it is to be understood that the invention is not limited to these precise embodiments. Numerous modifications, variations, and adaptations may be made to the particular embodiments of the invention described above without departing from the scope of the invention. The scope of the claims should not be limited by the preferred embodiments set forth in the examples, but should be given the broadest interpretation consistent with the description as a whole.

Immaterial modifications may be made to the embodiments described herein without departing from what is covered by the claims. The indefinite article "a" before a claim feature does not exclude more than one of the feature being present. Each of the individual features described here may be used in one or more embodiments and is not, by virtue only of being described here, to be construed as essential to all embodiments as defined by the claims.

The invention claimed is:

1. A modular staircase frame for supporting removable treads in the construction of a staircase, the modular staircase frame comprising:

two opposing sets of laterally spaced blades, each of the two opposing sets of laterally spaced blades comprising a plurality of adjacent blades, each of the plurality of adjacent blades defining a plurality of spaced apart openings, each of the plurality of adjacent blades being adjustably connected to a connecting blade for connecting two of said plurality of adjacent blades, each of the connecting blades defining plurality of spaced apart openings for overlapping the plurality of spaced apart openings defined by the plurality of adjacent blades, the connecting blades being adjustably connected to the plurality of adjacent blades by a fastener received through the spaced apart openings of the plurality of adjacent blades and the connecting blades, the plurality of adjacent blades being connected by the connecting blades to define an adjustably spaced ascending formation relative to a proximate adjacent blade, said two opposing sets of laterally spaced blades defining two laterally spaced ascending frame members, said two opposing sets of laterally spaced blades including a first pair of opposing laterally spaced blades each defining a flange extending laterally therefrom for anchoring said first pair of opposing laterally spaced blades to a first surface, and a final pair of opposing laterally spaced blades remote from the first pair of opposing laterally spaced blades, each of said final pair of opposing laterally spaced blades defining a flange extending laterally therefrom for anchoring said final pair of opposing laterally spaced blades to a second surface, the modular staircase frame further comprising at least one stiffener extending between the two opposing sets of laterally spaced blades, said at least one stiffener comprising two slidably connected overlapping panel members, each of said overlapping panel members defining a longitudinal groove, the longitudinal grooves of the overlapping panel members overlapping for receiving a fastener through said overlapping groove, whereby the overlapping panel members are movable between a plurality of intermediate positions for adjusting the length of the at least one stiffener, the at least one stiffener including a fastener for fastening the two overlapping panel members at a selected one of said plurality of intermediate positions.

2. The modular staircase frame of claim 1, wherein the modular staircase frame is assembled at a worksite.

3. The modular staircase frame of claim 1, wherein the plurality of adjacent blades are made of a material selected from the group consisting of aluminum, PVC, fiberglass, carbon fiber, plexiglass, polycarbonate, aluminum alloys, and titanium.

4. The modular staircase frame of claim 1, wherein each of the two opposing sets of laterally spaced blades further comprises at least one corner blade.

5. The modular staircase frame of claim 1, wherein the plurality of adjacent blades each define at least one flange for supporting a removable tread.

6. A method of constructing a modular staircase frame for supporting removable treads in the construction of a staircase, the method comprising:

arranging two opposing sets of laterally spaced blades, the arranging step being practiced such that: each of the two opposing sets of laterally spaced blades comprising a plurality of adjacent blades, each of the adjacent blades defining a plurality of spaced apart openings, each of the adjacent blades being adjustably connected to a connecting blade for connecting two of said adjacent blades, each of the connecting blades defining a plurality of spaced apart openings for overlapping the spaced apart openings defined by the adjacent blades, the connecting blades being adjustably connected to the adjacent blades by a fastener received through the spaced apart openings of the adjacent blades and the connecting blades, the two opposing sets of laterally spaced blades connected by the connecting blades further including a first pair of opposing laterally spaced blades and a final pair of opposing laterally spaced blades remote from the first pair of opposing laterally spaced blades, to define two laterally spaced ascending frame members;

anchoring the first pair of opposing laterally spaced blades to a first surface;

anchoring the final pair of opposing laterally spaced blades to a second surface;

adjustably connecting each of said plurality of adjacent blades with one of said connecting blades to define an ascending formation relative to an adjacent blade; and removably securing at least one stiffener between the two opposing sets of laterally spaced blades, said at least one stiffener comprising two slidably connected overlapping panel members, each said overlapping panel members defining a longitudinal groove, the longitudinal grooves of the overlapping panel members overlapping for receiving a fastener through said overlapping groove, whereby the overlapping panel members are movable between a plurality of intermediate positions for adjusting the length of the least one stiffener, the at least one stiffener including a fastener for fastening the two overlapping panel members at a selected one of said plurality of intermediate positions.

7. The method of claim 6, wherein the method is carried out at a worksite.

8. The method of claim 6, further comprising adjusting the length of the at least one stiffener to define the spacing between the two opposing sets of laterally spaced blades.

9. The method of claim 6, wherein each of the two opposing sets of laterally spaced blades further comprises at least one corner blade.

10. The method of claim 6, wherein the plurality of adjacent blades each define at least one flange extending laterally therefrom for supporting a removable tread.

* * * * *